US005159875A

United States Patent [19]

Cohen

[11] Patent Number: 5,159,875

[45] Date of Patent: Nov. 3, 1992

[54] NEWSPAPER CART FOR STACKING, TYING AND UNLOADING OF NEWSPAPERS

[76] Inventor: Barry Cohen, P.O. Box 357, Millwood, N.Y. 10546

[21] Appl. No.: 742,631

[22] Filed: Aug. 8, 1991

[51] Int. Cl.[5] ..... B65B 13/18

[52] U.S. Cl. ..... 100/34; 100/100; 280/47.24

[58] Field of Search ..... 100/1, 34, 100; 280/47.24; 211/50; 248/129

[56] References Cited

U.S. PATENT DOCUMENTS

| | | | |
|---|---|---|---|
| 1,722,193 | 7/1929 | Brandon | 280/47.24 |
| 2,723,863 | 11/1955 | Mattio | 280/47.24 |
| 2,921,694 | 1/1960 | Decker et al. | 280/47.24 X |
| 3,087,740 | 4/1963 | Mitty et al. | 280/47.24 X |
| 3,382,794 | 5/1968 | Lindholm et al. | 100/34 |
| 3,430,555 | 3/1969 | De Bruhl | 100/34 |
| 3,459,120 | 8/1969 | Brunette | 100/34 |
| 4,154,159 | 5/1979 | Ortega | 100/34 |

*Primary Examiner*—Harvey C. Hornsby

*Assistant Examiner*—Stephen F. Gerrity

*Attorney, Agent, or Firm*—Rodman & Rodman

[57] ABSTRACT

The stacking cart includes a frame having a base, sidewalls extending from the base, a rear wall adjoining the side walls and a front portion that is substantially open and unobstructed. Channels are formed in the base in criss-cross fashion permit a stack of newspapers supported on the base to be tied in place in the cart. Wheels are provided at the base to permit wheeled movement of the cart from one location to another. A stand portion is also provided at the base to permit pivoting of the cart toward the ground to unload newspapers stacked in the cart. The newspapers are unloaded through a front opening of the cart. The cart thus permits stacking of newspapers, tying of the stacked newspapers in place in the cart, movement of the stacked newspapers from one location to another, and unloading of the stacked newspapers by tilting the cart to dump the stacked newspapers out of the front of the cart. Under this arrangement, there is no need to lift or otherwise manually handle the newspapers.

19 Claims, 2 Drawing Sheets

NEWSPAPER CART FOR STACKING, TYING AND UNLOADING OF NEWSPAPERS

BACKGROUND OF THE INVENTION

The invention relates to stacking carts for newspapers, and more particularly to a novel stacking cart for stacking, bundling, transporting and unloading newspapers or other stackable paper.

The general public as well as local governments have become increasingly aware of the necessity to recycle trash and garbage to conserve natural resources and protect the environment. Accordingly, trash is being sorted by consumers and/or their communities for recycling and to provide another source of raw materials for the manufacture of new products. Recycling helps to conserve natural resources and reduces the amount of landfill sites which otherwise spoil the landscape and contribute to the pollution of groundwater. Recycling also helps reduce atmospheric pollution by decreasing the amount of trash disposed in incinerators.

Paper trash, and in particular newspaper, is of great concern because tremendous volumes of newspaper are disposed of on a daily basis. Consequently, the dumping and incineration of newspapers places an extreme burden on both landfills and incinerators. Thus, the practice of collecting newspapers for recycling is becoming more widespread and in certain cases compulsory based on local laws.

Newspapers, by their nature, are bulky and inconvenient to discard in domestic garbage containers. In many instances newspapers are haphazardly accumulated in loose piles in a household or business and then stacked at a collection site for pickup and disposal by the sanitation authorities. If the newspaper bundles are in disorder or disarray at the collection site, they cannot be efficiently collected.

One problem encountered by consumers in collecting newspapers for recycling is the lack of a device that permits convenient storing, bundling and unloading of a large stack of newspapers. If newspapers are piled in large stacks prior to disposal, there are attendant problems of lifting, moving and depositing such bundles at a collection site for pickup. A consumer also risks strain or injury when moving stacked or bundled newspapers to a collection site due to the weight and bulk of the newspapers.

Although baling machines such as disclosed in U.S. Pat. No. 1,246,923 for baling large amounts of paper have long been available, these machines are neither suitable for home use nor can the papers which have been baled in the machine be easily moved or transported to a desired location.

For small business establishments or households, a number of devices have been proposed for collection of newspapers as disclosed in U.S. Pat. Nos. 2,521,126; 2,636,432; 2,679,321; 3,382,794; 3,739,714; 3,850,092; 4,926,748 and Des. No. 228,052. Although each of these patents shows a device for stacking and/or bundling newspapers, none of them permit convenient moving and unloading of the stacks of paper after they have been bundled.

It is thus desirable to provide a stacking cart for newspapers and the like wherein the newspapers can be conveniently stacked, bundled, moved and unloaded.

OBJECTS AND SUMMARY OF THE INVENTION

Among the several objects of the invention may be noted the provision of a novel stacking cart for stacking, bundling and unloading newspapers, a stacking cart for stacking, bundling and depositing newspaper which enables a relatively large stack of newspapers to be easily and conveniently wrapped and tied into a bundle with a wrapping cord, a stacking cart for stacking, bundling and depositing newspaper which enables the bundled newspaper to be conveniently moved to a desired location, a stacking cart for stacking, bundling and depositing newspaper which enables the bundled newspaper to be easily dumped out of the cart and deposited at a desired location, and a stacking cart for stacking, bundling and depositing newspaper which is economical to build, lightweight, attractive and easy to use.

Other objects and features of the invention will be in part apparent and in part pointed out hereinafter.

In accordance with the invention, the stacking cart includes a generally rectangular frame having a base with oppositely disposed side walls extending from the base and a rear wall adjoining the oppositely disposed side walls.

The base includes a platform portion spaced above the floor portion. The platform portion defines the support surface or support plane upon which a stack of newspapers is accumulated. The frame also includes a front portion that is entirely open upwardly from the platform section and laterally from sidewall to sidewall.

A handle section is formed at the rear of the frame and extends from the rear wall. A pair of wheels are provided at the base of the frame near the rear wall and the base includes a stand portion provided below the floor. The stand portion enables the cart to maintain a normally upright position.

The platform section includes a lateral channel extending from one sidewall to another and a longitudinal channel that criss-crosses with the lateral channel and extends from the front of the frame through the rear wall of the frame.

The channels thus intersect and essentially divide the platform into four separate sections or quadrants that support a stack of newspapers within the stacking cart.

The stacking cart is formed of rods preferably of steel which can be spot welded. The rods can be finish coated with plastic or painted to provide the cart with an attractive appearance and resist oxidation.

A rod provided at the rear wall of the cart extends upwardly toward the handle to hold a roll of filament material such as twine. The twine is thus conveniently accessible for tying a stack of newspapers within the cart into a bundled unit.

The newspapers can be stacked to any selected height in the cart by depositing papers on top of each other. Tying of the stacked newspapers into a bundle is accomplished by passing a strand of cord through one of the channels in the platform, such as the lateral channel, to encircle the stack of newspapers. The encircling twine is then tied together. A second strand of twine is passed through the other channel in the platform, such as the longitudinal channel, to tie the stack of newspapers in criss-cross fashion, in place, on the cart.

Since the channels are recessed below the stack of newspapers, the tying together of such newspapers into a bundle can be accomplished conveniently and easily while the stack of newspapers is in place in the cart and does not require lifting o manipulating the newspaper stack.

The bundled newspapers are easily transported by pivoting the cart on its wheels to elevate the stand portion from the ground and permit wheeling of the cart from one location to another. After the cart has been wheeled to an unloading site, the cart is pivoted back to its normally upright position and then further pivoted onto the stand portion to elevate the wheels from the ground. The cart is thus pivoted forwardly to enable the tied stack of newspapers on the platform to dump out of the front opening of the cart onto the ground.

The unloading process is accomplished without lifting or manually handling the stack of newspapers.

The arrangement of the handle at the rear wall of the cart provides sufficient leverage to facilitate pivoting of the cart on its wheels or onto its stand portion to permit the unloading of the stack of newspapers.

The steel rods that constitute the cart are sufficiently spaced to keep the weight of the cart to a minimum without sacrificing needed strength to support the stack of newspapers.

The opening at the front of the cart enables the stacked papers to be conveniently dumped out of the cart and thereby prevent strain or injury to a person that often accompanies the lifting or manual handling of a stack of newspapers.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
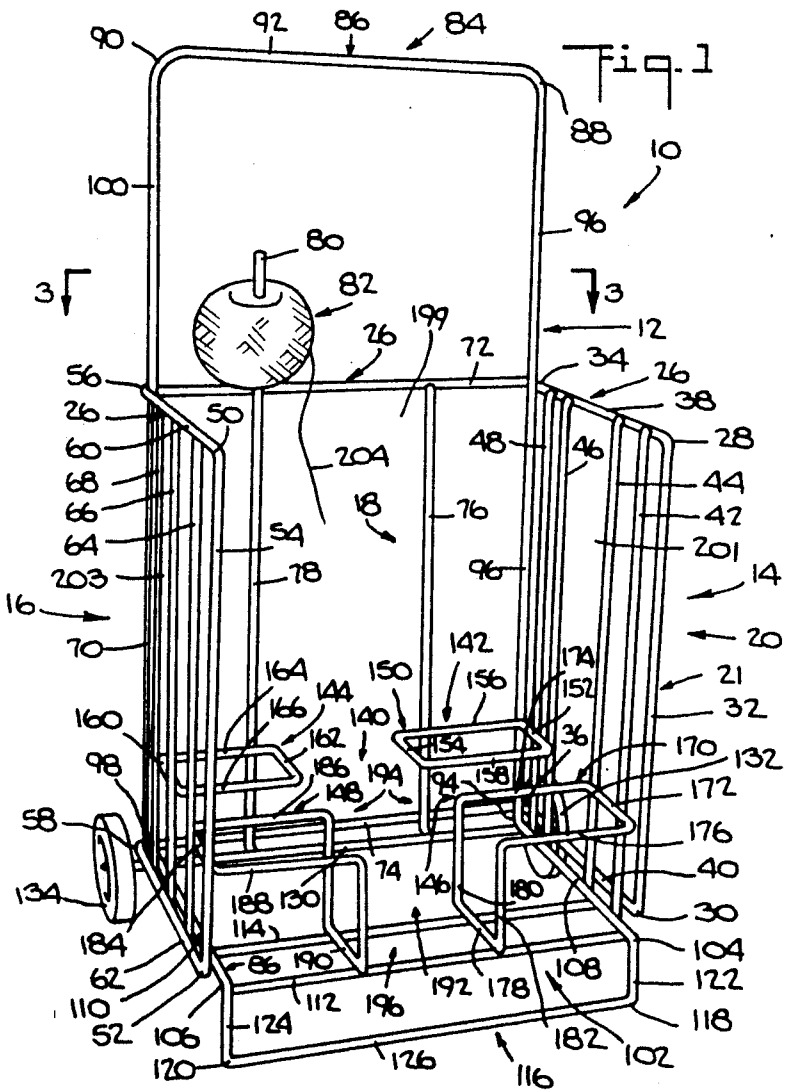
FIG. 1 is a perspective view of a stacking cart incorporating one embodiment of the invention.

A stacking cart incorporating one embodiment of the invention is generally indicated by the reference number 10 in FIG. 1. The cart 10 can be formed of any suitable material such as steel, aluminum, plastic or wood. Unless otherwise indicated, the preferred material used to form the stacking cart is steel rod which is primarily selected for economy of manufacture, strength, attractiveness, light weight and durability.

Referring to FIGS. 1–6, the stacking cart 10 includes a frame 12 having a pair of opposite side walls 14 and 16 joined by a rear wall 18. The frame 12 has a front portion 20 without a corresponding front wall. The front portion 20 is substantially open and unobstructed as indicated at 21 (FIG. 1).

It should be noted that the term lateral as used herein is intended to refer to the direction from one of the side walls 14,16 to the other side wall. The term longitudinal is intended to refer to the direction from the rear wall 18 to the front 20 and vice versa.

The side walls 14 and 16 are laterally spaced from each other a distance that is slightly longer by approximately 1½ inches to 2 inches than an edge 22 (FIG. 2) of a non-tabloid newspaper 24 in folded condition.

The side walls 14,16 and the rear wall 18 incorporate a main rod 26 that is bent in the form of a three-dimensional U (FIG. 1).

Figure 3:
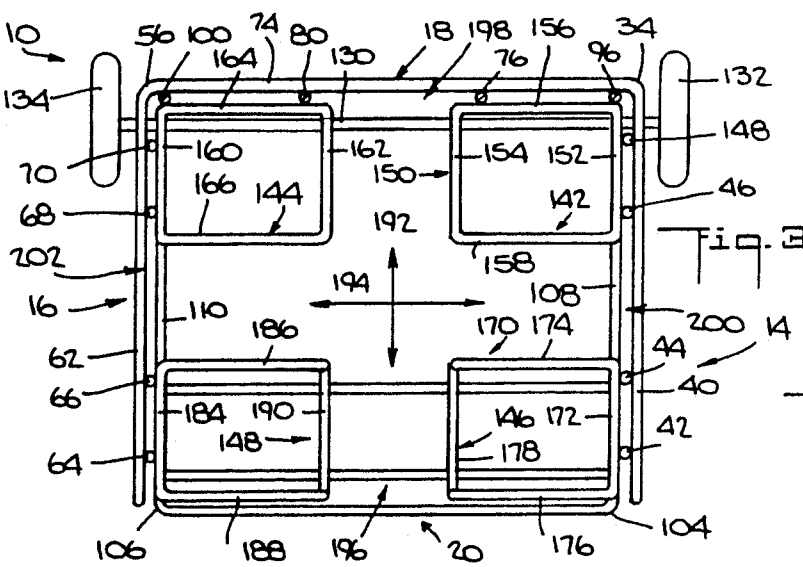
FIG. 3 is a sectional view thereof taken on the line 3—3 of FIG. 1.

At the side wall 14, which is symmetrical to the side wall 16, the main rod 26 is bent at right angles to form an upper front corner 28 and a lower front corner 30. A vertical section 32 of the main rod 26 joins the upper front corner 28 and the lower front corner 30. The main rod 26 is also bent at right angles to form an upper rear corner 34 (FIG. 1) and a lower rear corner 36. An upper longitudinal section 38 of the main rod 26 joins the upper front corner 28 and the upper rear corner 34, whereas a lower longitudinal section 40 of the main rod 26 joins the lower front corner 30 with the lower rear corner 36. Referring to FIGS. 1 and 3, intermediate vertical rods 42, 44, 46 and 48, provided at the side wall 14 are joined as by spot welding to the main rod sections 38 and 40.

At the side wall 16 the main rod 26 is bent at right angles to form an upper front corner 50 and a lower front corner 52. A vertical section 54 of the main rod 26 joins the upper front corner 50 and the lower front corner 52. The main rod 26 is also bent at right angles to form an upper rear corner 56 and a lower rear corner 58. An upper longitudinal section 60 of the main rod 26 joins the upper front corner 50 with the upper rear corner 56 and a lower longitudinal rod section 62 of the main rod 26 joins the lower front corner 52 with the lower rear corner 58. Intermediate vertical rods 64, 66, 68 and 70 provided at the side wall 16, are joined to the main rod sections 60 and 62.

At the rear wall 18 an upper lateral section 72 of the main rod 26 joins the upper rear corners 34 and 56 and a lower lateral section 74 (FIGS. 1 and 3) of the main rod 26 joins the lower rear corners 36 and 58. Intermediate vertical rods 76 and 78 provided at the rear wall 18 are joined to the lateral rod sections 72 and 74. However it will be noted that the intermediate vertical rod 78 has an extension portion 80 extending above the lateral rod section 72 to accommodate a spool of twine 82 (FIG. 1). Under this arrangement and referring to FIG. 1 in a clockwise direction, the rod sections 72, 38, 32, 40, 74, 62, 54 and 60 of the main rod 26 are continuations of each other that form a closed periphery.

A handle 84 provided at the rear wall 18 includes a main rod 86 bent at right angles to form upper corners 88 and 90. An upper lateral section 92 of the main rod 86 joins the upper corners 88 and 90.

The main rod 8 is also bent at right angles at the side wall 14 to form a lower rear corner 94 proximate the lower rear corner 36 of the main rod 26. A vertical section 96 of the main rod 86, which essentially defines the intersection of the side wall 14 and the rear wall 18, joins the upper corner 88 and the lower corner 94. The main rod 86 is further bent at right angles at the side wall 16 to form a lower rear corner 98 proximate the lower rear corner 58 of the main rod 26. A vertical section 100 of the main rod 86, which essentially defines the intersection of the side wall 16 and the rear wall 18, joins the upper corner 90 and the lower corner 98.

A base or floor 102 of the frame 12 includes the main rod 86 bent at a right angle at the side wall 14 to form a front upper corner 104. The main rod 86 is also bent at a right angle at the side wall 16 to form a front upper corner 106. A longitudinal section 108 of the main rod 86, which essentially defines the intersection of the side wall 14 and the floor 102, joins the upper front corner 104 with the rear corner 94. The intermediate vertical sections 42, 44, 46, and 48 at the sidewall 14 are joined to the longitudinal section 108.

A longitudinal section 110 of the main rod 86, which essentially defines the intersection of the side wall 16 and the floor 102, joins the upper front corner 106 with the rear corner 98. The intermediate vertical sections 64, 66, 68 and 70 at the sidewall 16 are joined to the longitudinal section 110. In addition, the intermediate lateral cross rods 112 and 114 at the floor base 102 are joined to the main rod sections 108 and 110.

A stand portion 116 of the frame 12 which can be formed as part of the base extends from the floor 102. The stand portion 116 includes the main rod 86 bent at right angles to form a lower front corner 118 below the upper front corner 104 proximate the side wall 14. The main rod 86 is also bent at a lower front corner 120 below the upper front corner 106 proximate the side wall 16. A vertical section 122 of the main rod 86 joins the upper front corner 104 with the lower front corner 18 and a corresponding vertical section 124 of the main rod 86 joins the upper front corner 106 with the lower front corner 120. In addition, a lateral rod section 126 joins the lower front corners 118 and 120.

Under this arrangement the main rod 86 is essentially bent in the form of a three-dimensional L with a vertical riser (the platform 116). Referring to FIG. 1, in a clockwise direction, the rod sections 92, 96, 108, 122, 126, 124, 110 and 100 of the main rod 86 are continuations of each other that form a closed periphery.

An axle member 130 is provided at the floor 102 and adjoins the longitudinal rod sections 108 and 110 proximate the corners 94 and 98 of the main rod 86. The axle member 130 extends laterally beyond the respective side walls 14 and 16 to support respective wheel members 132 and 134 which are rotatably mounted to the axle member 130 in any suitable known manner. The wheel members 132 and 134 can be formed of any suitable known material. The intermediate vertical sections 76 and 78 at the rear wall 18 are joined to the axle member 130.

A platform 140 of the frame 12 includes four platform sections 142, 144, 146 and 148 spaced from each other and elevated from the floor 102. The unobstructed opening 21 at the front portion 2 of the frame is defined above the platform 140 and extends between the sidewalls 14 and 16.

The platform section 142 is formed of a rod 150 bent to form a generally rectangular periphery that includes longitudinal rod sections 152, 154 and lateral rod sections 156 and 158 defining a support plane. The longitudinal rod section 152 is joined to the intermediate vertical rods 46 and 48 at the side wall 14 and the lateral rod section 156 is joined to the vertical section 96 and the intermediate vertical rod 76 at the rear wall 18.

The platform section 144 is similar to the platform section 142 and includes longitudinal rod sections 160, 162 and lateral rod sections 164, 166 defining a support plane that is coplanar with the support plane of the platform section 142. The lateral rod 166 at the side wall 16 is joined to the intermediate vertical rods 68 and 70 and the lateral rod section 164 at the rear wall 18 is joined to the vertical rod section 100 and the intermediate vertical rod 78.

The platform section 146 includes a rod 170 bent in the form of a step or three-dimensional L. The rod 170 includes a longitudinal rod section 172 at the side wall 14 joined to the intermediate vertical rod sections 42 and 44. Spaced and parallel lateral rod sections 174 and 176 extend at right angles from the longitudinal rod section 172 and define a support plane that is substantially coplanar with the support plane of the platform sections 142 and 144. A longitudinal rod section 178 of the platform 146 provided a the floor 102 is joined to the lateral base rod sections 112 and 114. Vertical rod sections 180 and 182 respectively intersect with the lateral rod sections 174 and 176.

The platform section 148 is of similar step shape to the platform section 146 and includes a longitudinal section 184 at the side wall 16 joined to the vertical rods 64 and 66. Spaced and parallel lateral rod sections 186 and 188 extend at right angles from the longitudinal rod section 172 to define a support plane that is substantially coplanar with the support planes of the platform sections 142, 144, and 146. A longitudinal rod section 190 of the platform 148 at the floor 102 is joined to the lateral base rod sections 112 and 114.

A longitudinal space or channel 192 is defined at the platform 140 and is bordered on one side by the platform sections 142 and 146, and bordered on the opposite side by the platform sections 144 and 148. The channel 192 extends longitudinally through the front 20 of the frame 12 at an open end 196 and through the rear wall 18 at an open end 198 (FIG. 3). The channel 192 has a predetermined vertical height from the floor 102 to the support plane of the platform 140. Since the front 20 is open at 21, the space above the channel end 196 is free and unobstructed. A space 199 (FIG. 2) above the channel end 198, is bordered by the vertical rods 76 and 78 and it is important that this space in the rear wall 18 be open to facilitate tying of a newspaper stack.

A lateral space or channel 194, also defined at the platform 140 criss-crosses the channel 192 and is bordered on one side by the platform sections 142 and 144, and bordered on the opposite side by the platform sections 146 and 148. The channel 194 extends laterally through the side wall 14 at an open end 200 and through the sidewall 16 at an open end 202. The channel 194 has a predetermined vertical height from the floor 102 to the support plane of the platform 140. The platform 140 thus incorporates the channels 192 and 194.

A space 201 (FIG. 2) above the channel end opening 200 in the sidewall 14 is bordered by the vertical rods 44 and 46 and is thus free and unobstructed to facilitate tying of a newspaper stack. Similarly, a space 203 (FIG. 2) above the channel end opening 202 in the sidewall 16 is bordered by the vertical rods 66 and 68 and is likewise free and unobstructed to facilitate tying of a newspaper stack.

The floor 102 and the platform 140 have been described as separate structural entities for purposes of clarity since the preferred embodiment is formed of rods. However, it should be noted that the floor 102 and the platform 140 can be collectively referred to as a base portion of the stacking cart 10. The stacking cart can also be formed of other material such as wood, plastic, or metal sheet and can be molded.

Figure 2:
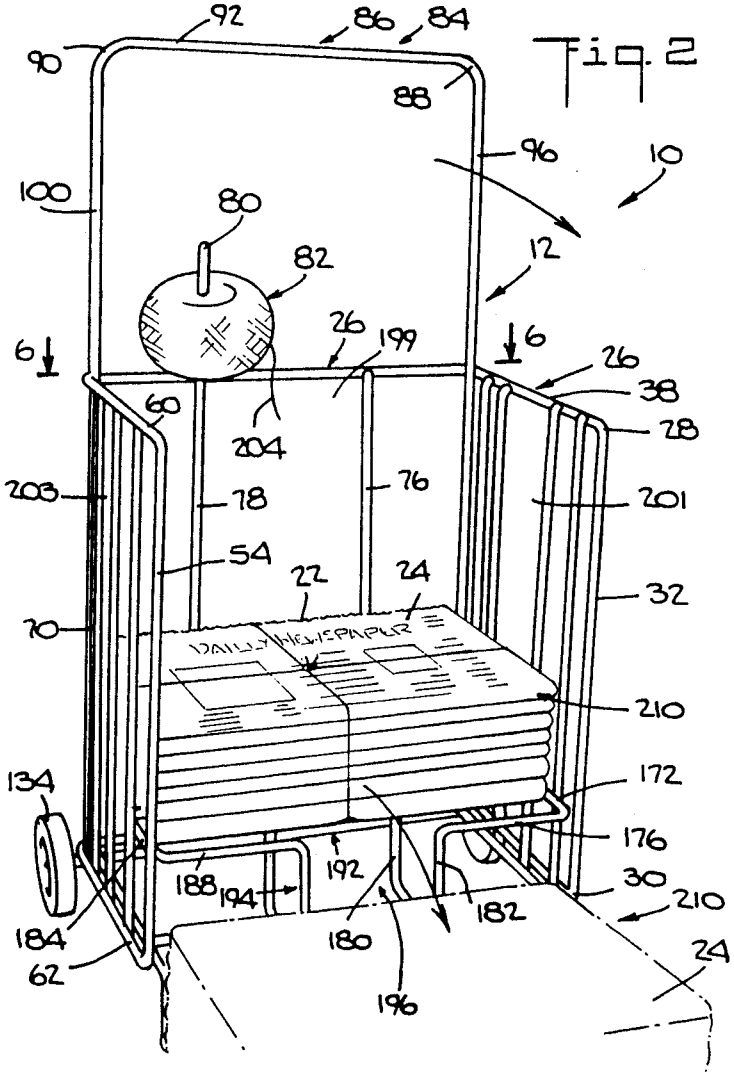
FIG. 2 is a perspective view similar to FIG. 1 showing the stacking cart with untied newspapers stacked thereon and dumped from the front of the cart.

In using the stacking cart 10, newspapers 24 in folded condition as shown in FIG. 2, are stacked one on top of another on the platform 140 to form a stack 210. The newspapers can be stacked to any height within the confines of the side walls 14,16 and the rear wall 18. Preferably the height of the newspaper stack should not extend vertically above the height of the side walls 14 and 16.

When a desired selected height of newspapers 24 in the cart 10 is reached, the stack of newspapers 210 can be tied together. The tying of the stack 210 of newspaper is easily accomplished without removing such stack from the cart 10.

It will be noted that the stack of newspapers 210 supported o the platform 140 is spaced above the floor 102. The stack of newspapers 210 covers the longitudinal channel 192 and the lateral channel 194. However, the opposite ends 196 and 198 (FIG. 3) of the longitudinal channel 192 are open and accessible to permit manipulation of a tying cord through the channel. Similarly, the opposite ends 200 and 202 of the lateral channel 194 are open and accessible for the same purpose.

Figure 5:
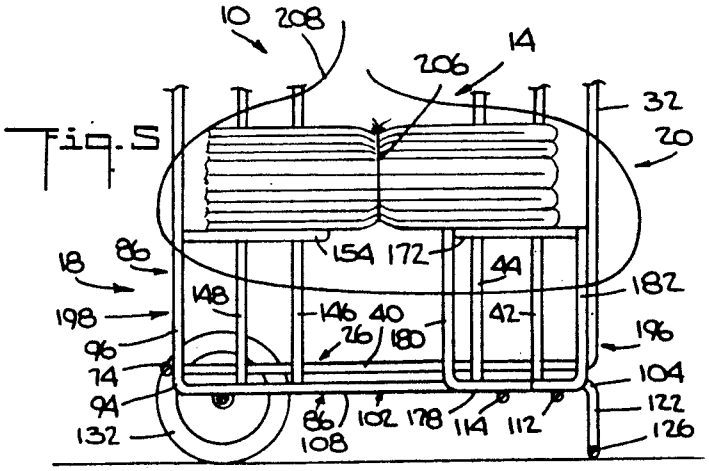
FIG. 5 is a fragmentary side elevational view, partly shown in section, showing the laterally tied newspapers being tied longitudinally with a cord.
Figure 4:
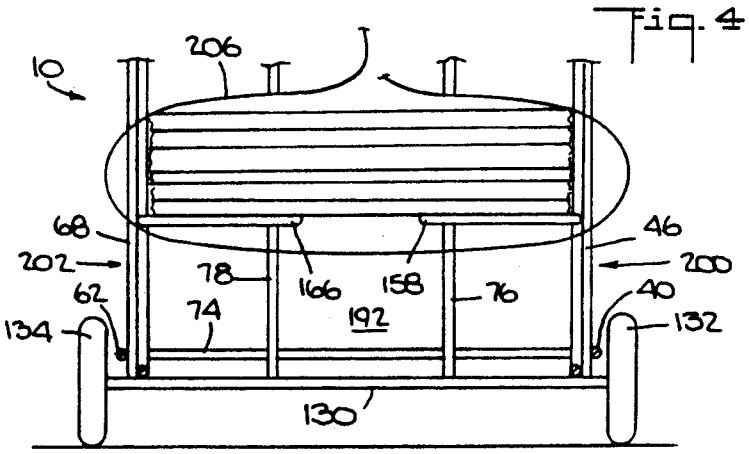
FIG. 4 is a fragmentary front elevational view, partly shown in section, including a stack of newspapers being tied laterally with a cord.

Twine 204 from the spool 82 is unwound to a first predetermined strand length 206 (FIG. 4) to permit passage through the lateral channel 194 for encirclement around the stack of newspapers 210 as shown in FIG. 4. The strand 206 is thus passed through the opposite lateral ends 200 and 202 of the lateral channel 194 underneath the stack of newspapers 210, laterally looped around the stack through the spaces 201 and 203 (FIG. 2) as shown in FIG. 4 and tied together as shown in FIG. 5. The strand 206 can then be cut before or after the lateral tying is completed.

Figure 6:
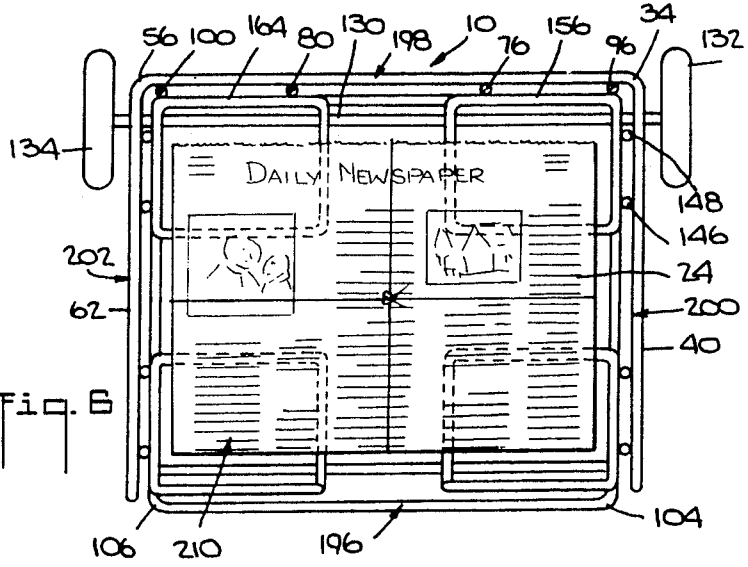
FIG. 6 is a sectional view thereof taken on the line 6—6 of FIG. 2 showing the stack of tied newspapers prior to being unloaded from the cart.

Another strand 208 of the twine 20 is passed through the opposite longitudinal ends 196 and 198 of the longitudinal channel 192 underneath the stack of newspapers 210, and around the stack through the rear space 199 and the front opening 21 to form a longitudinal loop around the newspapers that is also tied together as shown in FIGS. 2 and 6. The tied stack of newspapers 210 that has been tied in place on the cart 10 is thus bound in criss-cross fashion in the manner shown in FIGS. 2 and 6.

When it is desired to transport the newspapers 210 from one location to another, the frame 12 is tilted backwardly on the wheels 132 and 134 to elevate the stand portion 116 from the ground. The cart 10 can then be wheeled to any selected location such as an unloading site (not shown) for the newspapers.

At the unloading site, the cart 10 is tilted to its normal upright position, as shown in FIG. 1, with the front 20 being supported by the stand portion 116. Unloading of the stack of newspapers 210 from the cart 10 is accomplished by pivoting the cart forwardly on the stand portion 116, as indicated by the view in FIG. 2, to elevate the wheels 132 and 134 from the ground. As the cart 10 is forwardly pivoted on the stand portion 116, the stack of newspapers 210 will slide off the platform 140 onto the ground or onto any other dumping site for the newspapers. Under this arrangement, there is no need to lift or otherwise handle the newspapers 210.

The empty cart 10 is then wheeled back to its home location where an additional set of newspapers can be accumulated for stacking, bundling and subsequent unloading.

It should be noted that the stacks 210 should be unloaded after they are tied in order to permit convenient tying on the cart 10 of another stack of newspapers.

Although the invention has been described in connection with the stacking of newspapers, any other papers such as magazines, correspondence, photocopy paper and computer printout paper can be similarly stacked, bundled and unloaded. The stacking cart 10 can be made to a selected size depending upon the size of the paper to be accommodated.

Some advantages of the invention evident from the foregoing description include a stacking cart that permits convenient stacking, tying, movement and unloading of newspapers without the need to lift or otherwise handle the newspapers. The newspapers are conveniently stored, stacked, tied and unloaded using only the stacking cart. Since the stacking cart can be made of rod, it is relatively lightweight, strong and easy to keep clean.

A criss-cross arrangement of channels formed in the base of the cart extend into the side walls and into th rear wall and front of the cart. Openings in the side walls and the rear wall and at the front of the cart that align with or extend upwardly from the channels are unobstructed channels up to the full height of the cart to permit tying of a stack of newspapers of any size that fits in the cart. Thus the user can conveniently tie a stack of newspapers of any size that fits in the cart without manipulating or otherwise handling the newspapers.

In view of the above, it will be seen that the several objects of the invention are achieved and other advantageous results attained.

As various changes can be made in the above constructions without departing from the scope of the invention, it is intended that all matter contained in the above description or shown in the accompanying drawings shall be interpreted as illustrative and not in a limiting sense.

What is claimed is:

1. A stacking cart for newspapers comprising, a) a frame having a base defining a support for supporting newspapers thereon, oppositely disposed side walls extending from said base, a rear wall joining said side walls, a front portion opposite said rear wall and being entirely open above said support from one side wall to the other side wall, said opening extending unobstructed from said support to permit unloading of newspapers disposed on said support through said front portion.

b) a lateral channel and a longitudinal channel being formed in said base and being open at said support, said lateral channel extending through the opposite side walls and having opposite lateral end openings at respective said side walls, said longitudinal channel criss-crossing said lateral channel and extending from said front portion through said rear wall, and having on longitudinal end opening at said front portion and an opposite longitudinal end opening at said rear wall, and c) wheel means on said frame for permitting wheeled movement of said cart.

2. The stacking cart as claimed in claim 1, wherein said lateral and longitudinal channels are formed to criss-cross substantially at the center of said base to permit the passage of a flexible filament through each of said channels and around a stack of newspapers on said support to bind said stack of newspapers in place in said stacking cart.

3. The stacking cart as claimed in claim 1, wherein said base includes a platform and a floor below said platform, said platform including said support spaced above said floor.

4. The stacking cart as claimed in claim 3, wherein said platform includes a lateral channel extending through said opposite sidewalls and a longitudinal channel criss-crossing said lateral channel and extending from the front portion of said frame through said rear wall, said lateral and longitudinal channels being opened at said support.

5. The stacking cart as claimed in claim 3 wherein an axle for said wheels is provided at the floor portion of said base.

6. The stacking cart as claimed in claim 1, wherein said base includes a stand portion at the front portion of said frame, said frame being pivotable upon said stand portion to tilt said front portion toward the ground to permit unloading of newspapers disposed of on said support from said cart through the front portion of said frame.

7. The stacking cart as claimed in claim 1, further including a handle extending from said rear wall.

8. The stacking cart as claimed in claim 1, wherein said frame is constructed of a plurality of rods secured together by bonding.

9. The stacking cart as claimed in claim 8 wherein said rods are steel rods secured together by sport welding.

10. The stacking cart as claimed in claim 1 wherein said side walls each include an opening in alignment with said lateral channel and said rear wheel includes an opening in alignment with said longitudinal channel, said openings extending unobstructed from said support to permit tying of a predetermined stack height of newspapers in place on said support means.

11. A stacking cart for stacking, bundling and depositing newspapers comprising, a) a rectangular frame having a base, oppositely disposed side walls extending from said base, a rear wall joining said side walls, a front opposite said rear wall, said front having an open portion extending between said side walls, b) said base including support means for supporting a stack of newspapers, said support means bordering said opening portion such that said open portion extends upwardly from said support means, said support means comprising a platform formed with a laterally extending channel and a longitudinally extending channel that criss-cross, said laterally extending channel extending through the opposite side walls and said longitudinally extending channel extending through the rear wall and the front of said frame, c) said base including stand means for maintaining said cart in a normally upright position and for permitting tilting of the frame on said stand means whereby newspapers stacked on said support means can be dumped out of the open portion of said frame when said frame is tilted on said stand means, and d) a pair of wheels at said base to permit the cart to be rolled to a desired location with the stack of newspapers on said support means.

12. The stacking cart as claimed in claim 11 wherein said side walls include openings in alignment with said lateral channel and said rear wall includes an opening in alignment with said longitudinal channel, said openings extending unobstructed from said support to permit tying of a predetermined stack height of newspapers in place on said support means.

13. The stacking cart as claimed in claim 11 wherein said base has a floor portion and an axle for said wheels is provided at said floor portion.

14. The stacking cart as claimed in claim 11, further including a handle extending from the rear wall to facilitate tilting of the cart on the stand potion to dump the stack of newspapers on said support means out of the open portion of the cart.

15. The stacking cart as claimed in claim 11, wherein said wheels are proximate the rear wall of said frame, said cart further including a handle extending from the rear wall to facilitate tilting of the cart on said wheels to permit wheeled movement of said cart.

16. The stacking cart as claimed in claim 11, wherein said lateral and longitudinal channels intersect at substantially the center of the said platform to permit the passage of a filament laterally and longitudinally around a stack of newspapers supported on said platform to bind said newspapers into a bundle.

17. The stacking cart as claimed in claim 11, further including a prong joined to said frame for holding a supply of filament for tying and securing a stack of newspapers on said support means into a bundle, in place, in said cart.

18. The stacking cart as claimed in claim 17 wherein said prong is joined to said rear wall and is adapted to hold a spool of filament for tying a stack of newspapers on said support means, in place, in said cart.

19. The stacking cart as claimed in claim 11 wherein said framework is constructed of a plurality of rods secured together by welding.

* * * * *